US009289659B2

(12) United States Patent
Franklin

(10) Patent No.: US 9,289,659 B2
(45) Date of Patent: Mar. 22, 2016

(54) ADJUSTABLE PUTTER HEAD ALIGNMENT AID

(71) Applicant: Nike, Inc., Beaverton, OR (US)

(72) Inventor: David N. Franklin, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/066,803

(22) Filed: Oct. 30, 2013

(65) Prior Publication Data

US 2015/0119160 A1 Apr. 30, 2015

(51) Int. Cl.

*A63B 69/36* (2006.01)
*A63B 53/04* (2015.01)
*A63B 53/06* (2015.01)

(52) U.S. Cl.

CPC ..... *A63B 53/0487* (2013.01); *A63B 53/065* (2013.01); *A63B 69/3685* (2013.01); *A63B 2053/0441* (2013.01)

(58) Field of Classification Search

CPC ..... A63B 69/3685; A63B 53/0487; A63B 2053/0441; A63B 53/065
USPC ..... 473/231–254, 340–341
See application file for complete search history.

(56) References Cited

U.S. PATENT DOCUMENTS 1,173,384 A * 2/1916 Rees ..... 473/251
1,659,231 A * 2/1928 Baack ..... 473/251
3,292,928 A * 12/1966 Billen ..... 473/244
3,384,376 A * 5/1968 Greenlee ..... 473/236
3,529,830 A * 9/1970 Palotsee ..... 473/244
3,589,731 A * 6/1971 Chancellor, Jr. ..... 473/333
3,917,277 A * 11/1975 Beck et al. ..... 473/244
4,291,883 A * 9/1981 Smart et al. ..... 473/244
4,819,943 A * 4/1989 Szczepanski ..... 473/252
4,953,867 A * 9/1990 Rigsby ..... 473/238
5,213,332 A * 5/1993 Fahy et al. ..... 473/243
5,240,253 A * 8/1993 Cooper ..... 473/236
5,340,104 A * 8/1994 Griffin ..... 473/340
5,447,313 A * 9/1995 Finley ..... 473/244
5,709,611 A * 1/1998 Intag ..... 473/236
6,558,268 B2 * 5/2003 Tindale ..... 473/244
7,104,898 B1 * 9/2006 Caserta ..... 473/236
7,410,423 B2 * 8/2008 Pinder ..... 473/244
7,556,569 B1 * 7/2009 Caserta ..... 473/236
7,588,499 B2 * 9/2009 Tateno ..... 473/251
7,614,960 B2 * 11/2009 Miller et al. ..... 473/236
7,758,439 B2 * 7/2010 Roenick ..... 473/238
7,905,792 B1 3/2011 Stites et al.
7,927,231 B2 * 4/2011 Sato et al. ..... 473/334
8,075,416 B2 12/2011 Stites et al.
2006/0223649 A1 * 10/2006 Rife ..... 473/334
2006/0229137 A1 * 10/2006 McCarthy ..... 473/251
2013/0040750 A1 * 2/2013 Simizu ..... 473/240

* cited by examiner

*Primary Examiner* — Sebastiano Passaniti
(74) *Attorney, Agent, or Firm* — Banner & Witcoff, Ltd.

(57) ABSTRACT

A golf club head with a body and an adjustable alignment aid housed on a top surface of the body is provided. The adjustable alignment aid is pivotable relative to the top surface, either two-dimensionally or about an axis of rotation transverse to the top surface. The adjustable alignment aid may be coupled to the remainder of the golf club head through a resistive connection and may be shifted to assist a golfer in squaring the face of the golf club face to a perceived eye line and resulting in the golfer being able to better square the golf club head with the eye line at a point of contact. The golf club head may be a putter head.

23 Claims, 21 Drawing Sheets

ADJUSTABLE PUTTER HEAD ALIGNMENT AID

FIELD OF THE INVENTION

The present invention relates to a golf club head having an adjustable alignment aid, more particularly, to a putter head having an adjustable alignment aid.

BACKGROUND

Putting is an aspect of golf in which a golfer attempts to hit or "putt" the ball into the hole from the ball's position on a green or a like surface. Preferably, the golfer can putt the ball into the hole in as few attempts as possible. To do so, a golfer may align, either by sight or other perceptive techniques, the golf ball so as to hit the ball with a velocity and direction that will cause the ball to terminate its travel path in the hole or as close to the hole as possible if not in the hole. As such, a golfer can achieve a lower score which is preferred and the objective according to golf rules. Various techniques may be utilized by golfers in order to putt the golf ball in a preferred manner such that the golf ball travels into or near the hole more frequently. Among the techniques a golfer may use is to determine a desired path and velocity for the ball to travel. The golfer may attempt to putt the golf ball on this desired path and accordingly may attempt to align himself in a manner to facilitate putting the ball along the desired path with a desired velocity to go into or near the hole.

SUMMARY

A golf club head with an adjustable alignment aid housed within the body of the club head is provided. The adjustable alignment aid includes a moveable pin coupled at one end to the front of the club that extends rearwardly. The adjustable alignment aid may be of a number of configurations including an off-set pin and rotatable element.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

Figure 1A:
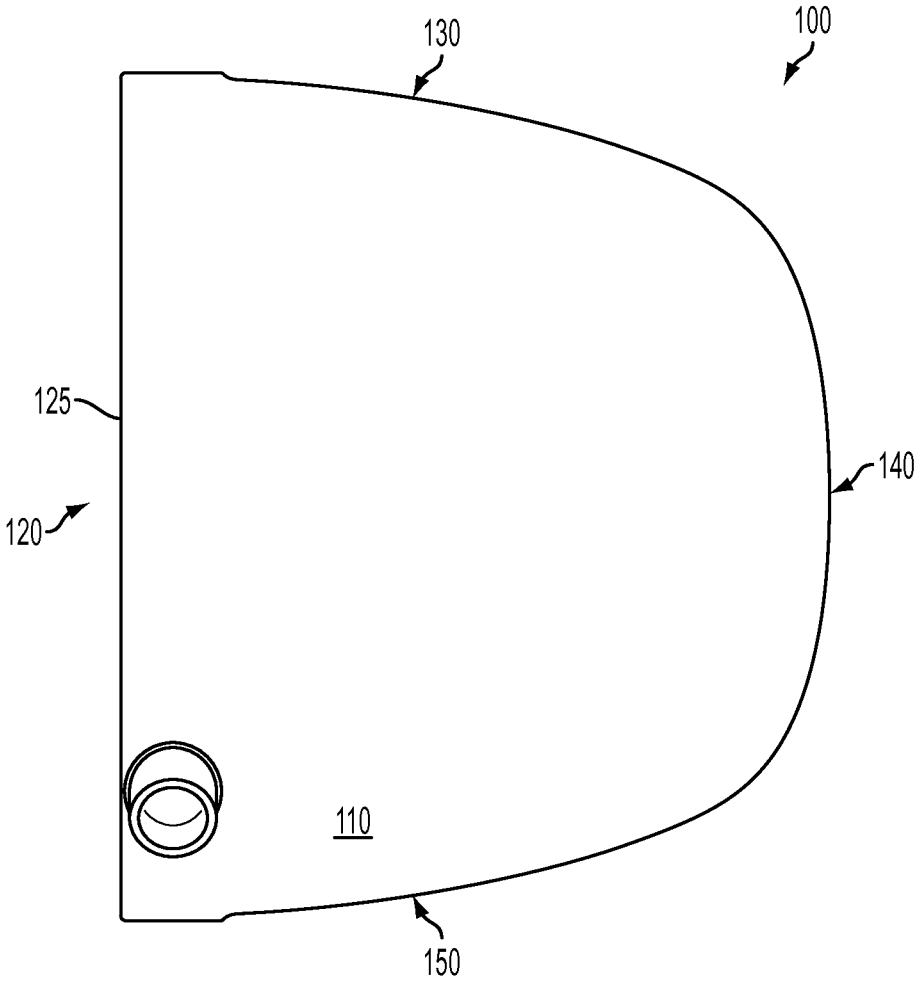
FIGS. 1A-1D depict top, toe end, heel end, and front views respectively of an illustrative golf club head.
Figure 1B:
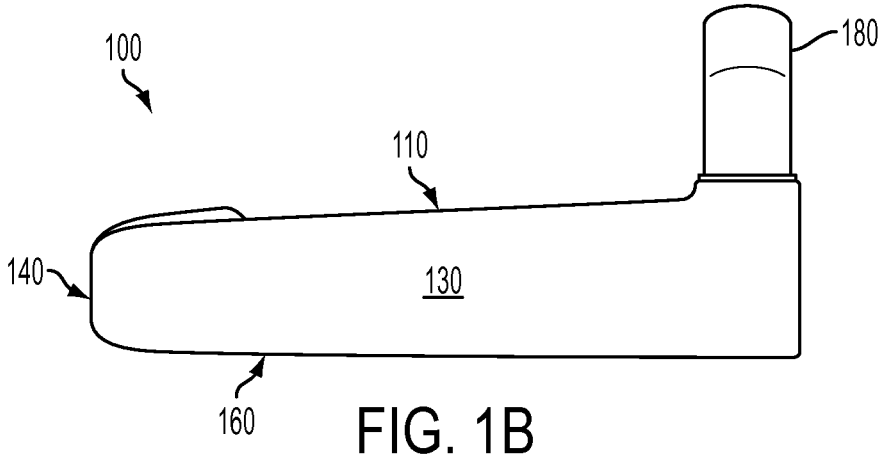
Figure 1C:
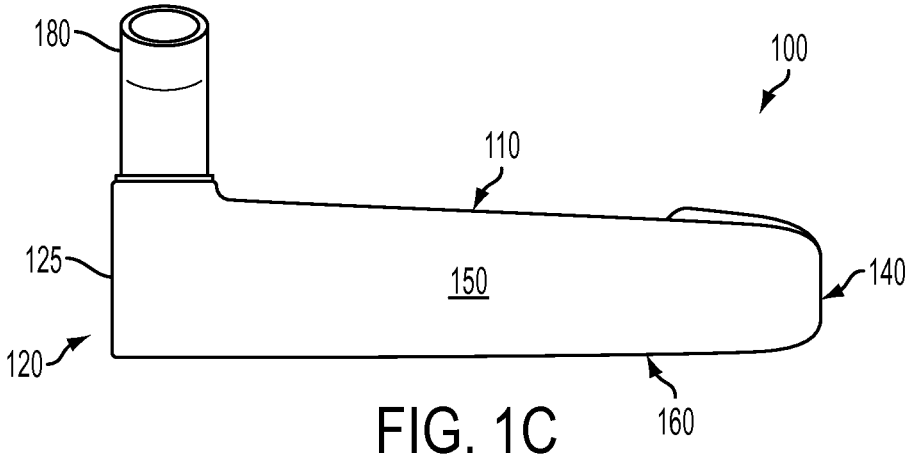
Figure 1D:
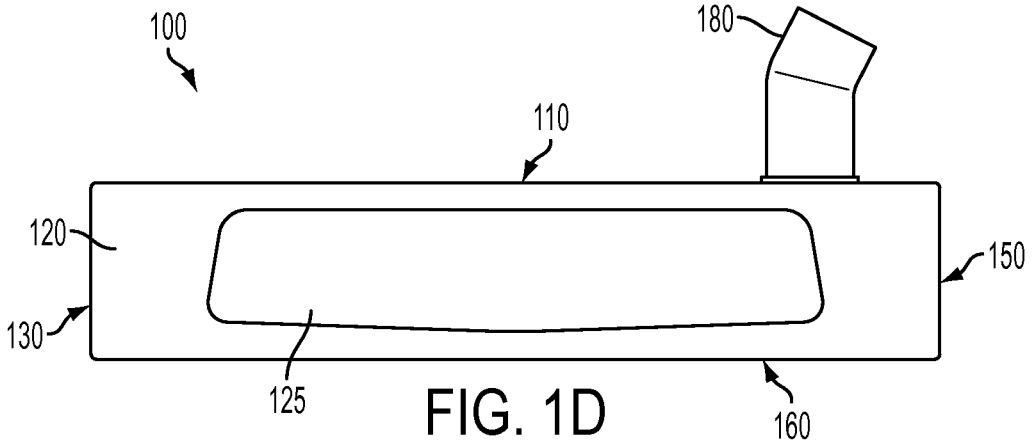

In the following description of the various embodiments, reference is made to the accompanying drawings that depict illustrative arrangements in which the invention may be practiced. It is understood that other embodiments may be utilized and modifications may be made without departing from the scope of the present invention.

The present invention is described particularly in terms of an alignment aid for a putter head. However, it is seen that such alignment aid may be useful on wood-type club heads and iron-type club heads.

Aspects of the invention compensate for perceptual variances in vision. The invention provides alignment aids on a putter to be custom tuned in order that they appear perpendicular or otherwise appropriately aligned to the target regardless of variables in a golfer's set up, stance, and/or vision (e.g., right eye or left eye dominance). A perpendicular line on a putter does not appear the same to all players. Varying factors in visual perception determine a person's interpretation of right angles and therefore affect a golfer's ability to align a putter to an intended target line. These factors can include eye position over the golf club or a golfer's level of eye dominance among others. This invention compensates for these varying perceptions and allows for individual customization of alignment aids to improve the player's alignment of the putter. The goal is to improve alignment to the intended target by causing the alignment aid to appear perfectly oriented to a player's unique visual perception. This will improve alignment and increase player confidence.

FIGS. 1A-1D are schematic top, toe end, a heel end, and front views, respectively, of an illustrative putter head 100. As apparent from the figures, a golf club head 100 may illustratively be considered to include a top 110, a front 120, a toe end 130, a rear 140, a heel end 150, and a bottom (or sole) 160. Further, a golf club head 100 typically includes a hosel 180 formed to, among other things, facilitate connection of the golf club head 100 to the shaft 190 and grip 195 (FIG. 2) Hosel(s) 180 and shaft(s) 190 are well known in the art. Hosels 180 are commonly formed with the remainder of the putter head 100 as a single body member. Shaft 190, as is also known in the art, may be varied in length, material composition, stiffness, flex and other traits and features. A grip 195, by which a golfer 10 holds or grips the golf club, is attached to the shaft 190 at the end opposite the head 100. Grips 195 are known and may vary significantly depending on preferences, ergonomic characteristics, and tendencies of the golfer. Like other golf club features, the shaft 190 and grip 195 will often be selected based upon golfer "feel" as well as traits relating to the golfers physical make-up and putting or swing characteristics and tendencies.

Front surface 120 typically includes a hitting surface 125 configured for striking a golf ball. Hitting surface 125 may include any of a variety of features, configurations, shapes, surfaces and details. For example, hitting surface 125 may include a series of grooves or other textures that facilitates travel of the golf ball when the hitting surface 125 impacts a golf ball. Spacing, size, depth, shape, contour and orientation of these grooves may be varied to provide varied characteristics. Also, hitting surface 125 may be formed of a softer or harder material or may be treated to strengthen or soften the material in anticipation of the hitting surface repeatedly being used to impact the golf ball. By varying the hardness of some of the material the feel of the golf club head may be varied.

For example, it may be desirable to have a softer hitting surface 125 compared to the other surfaces of the golf club head. Many other forms of surface treatments and ornamentation may be incorporated into the hitting surface 125, from hardened materials to holes, grooves, and corrugation and various other hitting surface materials, structures and configurations that are well known.

The illustrative golf club head 100 illustratively shown in FIGS. 1A-1D may be commonly referred to as a putter head 100. Putters are golf clubs often formed with a grip 195, a shaft 190, and golf club head 100 that is formed and configured for hitting or putting a golf ball on a "green" or other like surfaces upon which a golfer may putt a golf ball. Generally, a putter 199 has a head 100 formed and shaped to cause a ball to be rolled along a relatively smooth surface when the ball 201 is properly struck by the club 199. The golf club head 100 can be weighted. Putters vary greatly in their shape, size and appearance. A putter is generally swung slower and with a much shorter swing than other types of golf clubs such as wood-type or iron-type golf clubs since putters are generally used to hit golf balls shorter distances with more precision. As such, putters may be formed to facilitate hitting the golf ball in a precise direction and with a precise speed to assist the golfer in hitting the golf ball into or near to the hole 299.

Accordingly, the putter head 100 may be formed with less focus on aerodynamic principles as well as with less focus on the feel of the club in a full backswing and downswing as performed with other types of golf clubs as known in the art. This is possible since a putter is typically only moved through a partial backswing and a partial downswing. The golf club head 100 may be weighted throughout to provide more feel to the golfer in such a swing. The weighting may be accomplished by having material dispersed throughout the golf club head 100 or it may be accomplished utilizing one or more regions of material placed or inserted in specific locations. The weighting of the golf club will help facilitate the stroke of the putter 199 and will allow a smoother and more accurate putt. Therefore, the weighting of the golf club can be balanced in manners to place the center of mass at certain locations to provide a preferred stroke and contact with the golf ball. Additionally, the golf club head 100 may have a certain desired overall weight such that the momentum of the putter will be less affected when the golf club head 100 contacts the stationary ball as certain momentum and force is needed to start the ball rolling to overcome the inertia of the stationary golf ball while still holding the swing and club in a controlled path.

Other characteristics of the putter head 100 may be formed to facilitate a preferred putting stroke. For example, a bottom surface 160 (or portions of the bottom surface 160) of the golf club head 100 has a flat profile complimentary to a relatively smooth surface of a putting green. The bottom surface 160 may be a continuous solid profile or in many cases the bottom surface 160 may include cavities, recesses, holes and other variations in the topography of the bottom surface 160. Additionally, the putter head 100 may have a hitting surface 125 formed of a distinct material, surface coating, or finish compared to the rest of the front surface 120. In one configuration, a hitting surface 125 may be formed as an insert on the front surface 120 of the putter head 100. The insert 125 may be formed of a softer material or a have a softer coating than the remainder of the front surface 125 so that weighting properties may be optimized while still providing a softer (and/or more absorbent) hitting surface 125 to provide enhanced control for the golfer when putting. Additionally, the shape of the putter head 100 may be formed to provide alignment properties resulting in a preferred putting stroke. The putter head 100 may be an elongated structure in one configuration. Also, the putter head 100 can include cut-outs, bulges, spherical structures, channels and various other configurations that facilitate alignment and/or weighting of the club. In particular, causing a center of mass of the putter head to be aligned with a "sweet spot" on the hitting surface 125 is desirable in many instances.

Figure 2:
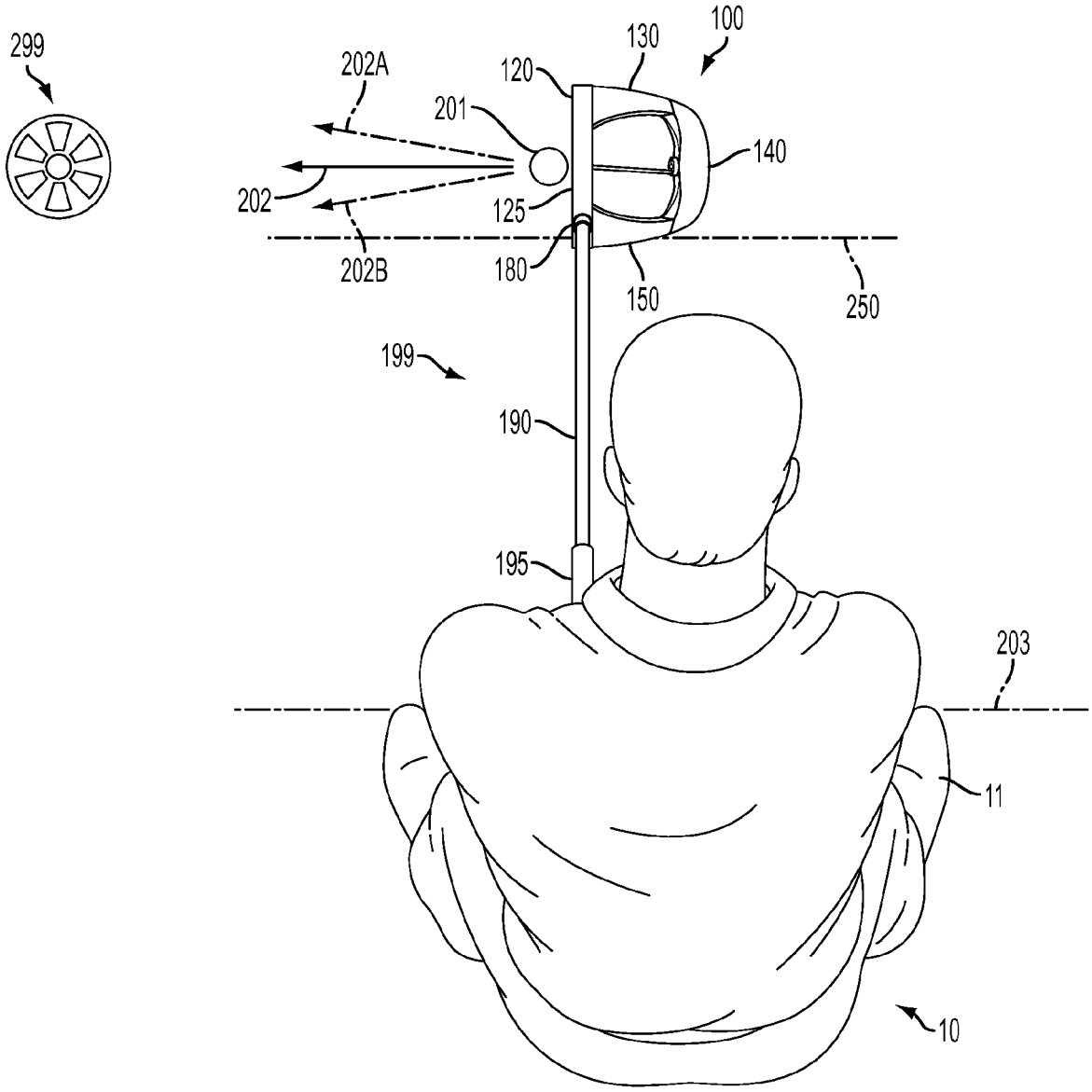
FIG. 2 is an illustrative top plan view of a golfer addressing a golf ball with a putter.

FIG. 2 is an illustrative top plan view of a golfer 10 addressing a golf ball 201 with a golf club head 100. The addressing state shown in FIG. 2 is generally considered an illustrative start position for a golfer putting a golf ball 201. The golf club 199 (here a putter) typically includes a shaft 190 coupled to the head 100.

As apparent in FIG. 2, golfers generally position their feet 11 in an orientation 203 generally aligned in the direction in which the golfer desires or is aiming to putt the golf ball 201. The golfer's position in FIG. 2 may be referred to as an addressing state or a starting state. For reference purposes, broken line 250 illustrates a heel end plane running along the heel end 150 of the golf club head and perpendicular to the ground (assuming the ground has a relatively smooth surface). As apparent, the heel end plane 250, when the golfer 10 is in a typical addressing state as shown in FIG. 2, is parallel to the general desired travel path 202 and the golfer's feet alignment 203. Foot positioning may be varied from this illustrative positioning as is known in the art so as to be askew by a certain rotation from the general desired travel path. For illustrative purposes in FIG. 2, arrow 202 demonstrates one "general" desired path of travel of the ball 201 after the golfer 10 strikes the golf ball 201 with the front 120 (the face) of the golf club 199. As will be explained in more detail later with regard to FIG. 4, a golfer's general desired travel path after contacting the ball 201 may align with a golfer's desired path of travel 202. In the configuration of FIG. 2, the golfer's feet, as demonstrated by the arrow 203, illustratively depicts the alignment of the golfer's feet or stance as being generally parallel with the general desired travel path of the ball 202. As known, an actual travel path of the ball 201 may vary from the general desired travel path as the front surface 120 including the hitting surface 125 of a golf club head of a putter 100 may not be square or aligned with the golfer's desired path of travel 202 or the general desired path of travel of the golf ball 202 after the golfer has made contact.

As generally known and described in more detail later, putting greens and like surfaces (including fairways near a putting green) are typically not completely smooth and have what is commonly referred to and known in the art at as "breaks." For example, a putting green may have a number of slopes, hills, and other varied topography such that a golfer must aim or align a putt or other shot, taking into account "the break" that will cause the path of actual travel of the ball to be curved and varied. Since the ball typically rolls across the grass of the green (or like surface) as is it travels, the ball's travel path will be affected by the surface of the green including variations in the topography. For example, if a golf ball 201 is resting on one side of a green and the hole is on the other side of a green and between the hole and the ball is a hill that slopes downward from right to left, a golfer must hit the ball with an initial direction that is a certain distance or angle rightward of the hole because the hill sloping downward from right to left (as a result of gravity) will force the ball's path of travel to curve leftward during travel in varying extent depending on the specifics relating to the moving or rolling golf ball and its path of travel including particular size gradients of the right to left slope, velocity, direction, friction between rolling golf ball and the surface of the green, wind, and various other factors as are known.

A golfer may view the position of a golf ball 201 relative to a hole 299 from a number of positions to judge the breaks, slopes, distance and other golf course and environmental features to be able to formulate a desired travel path for the ball as well as a desired initial velocity of the golf ball when he putts the golf ball such that the ball 201 will go in the hole or come to rest as close to the hole as possible consistent with the objectives of the sport of golf as known in the art. The golfer may use a desired path of travel 202, 202A, 202B to formulate how the golfer wishes to hit or putt the golf ball. Since the golfer will often be viewing and formulating a desired path of travel 202, 202A, 202B from above and or behind the ball, the putter head 100 with an adjustable alignment aid 200 facilitates the golfer's ability to determine the desired path of travel 202, 202A, 202B and then to hit or putt the golf ball such that the hitting surface 125 contacts the ball in an orientation square with the desired path of travel 202, 202A, 202B (or others not shown) causing the golf ball to initially travel along the desired path of travel line 202, 202A, 202B (or others not shown).

FIGS. 3A-3E are top (2), bottom, front perspective, and rear perspective views of a putter head 100 that includes an adjustable alignment aid 200 housed in recess 112 in top surface 110 of the golf club head 100. The recess may extend partially through or fully through the golf club head. The recess allows for unimpeded movement of the adjustable alignment aid as well as allows the user to see the adjustable alignment aid. The golf club head may be formed of one or several pieces. For example, front, toe, and heel parts may be formed of a single piece and rear may be a separate piece that is then coupled to the rest of the club head. Having a separate rear part may be preferable for production of the golf club head depending on configuration of the adjustable alignment aid.

Figure 3A:
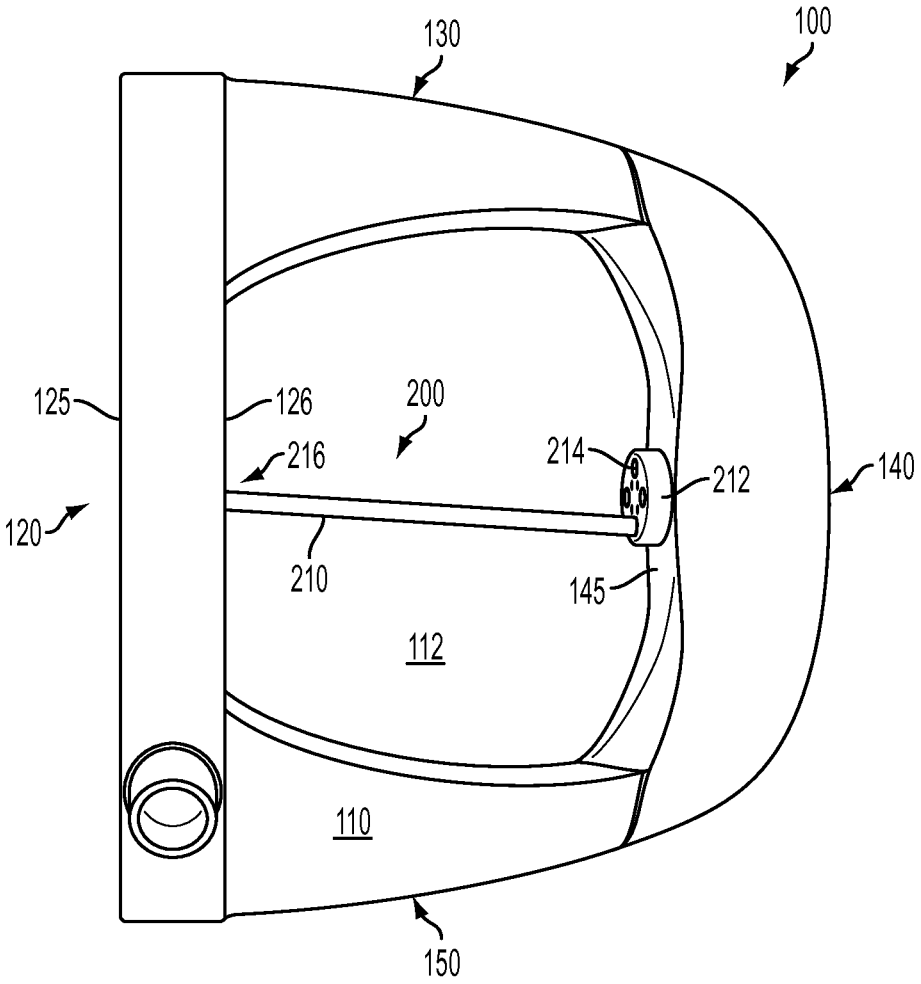
FIGS. 3A-3E are illustrative schematic top (2), bottom, front perspective, and rear perspective and of a putter head including an adjustable alignment aid.
Figure 3B:
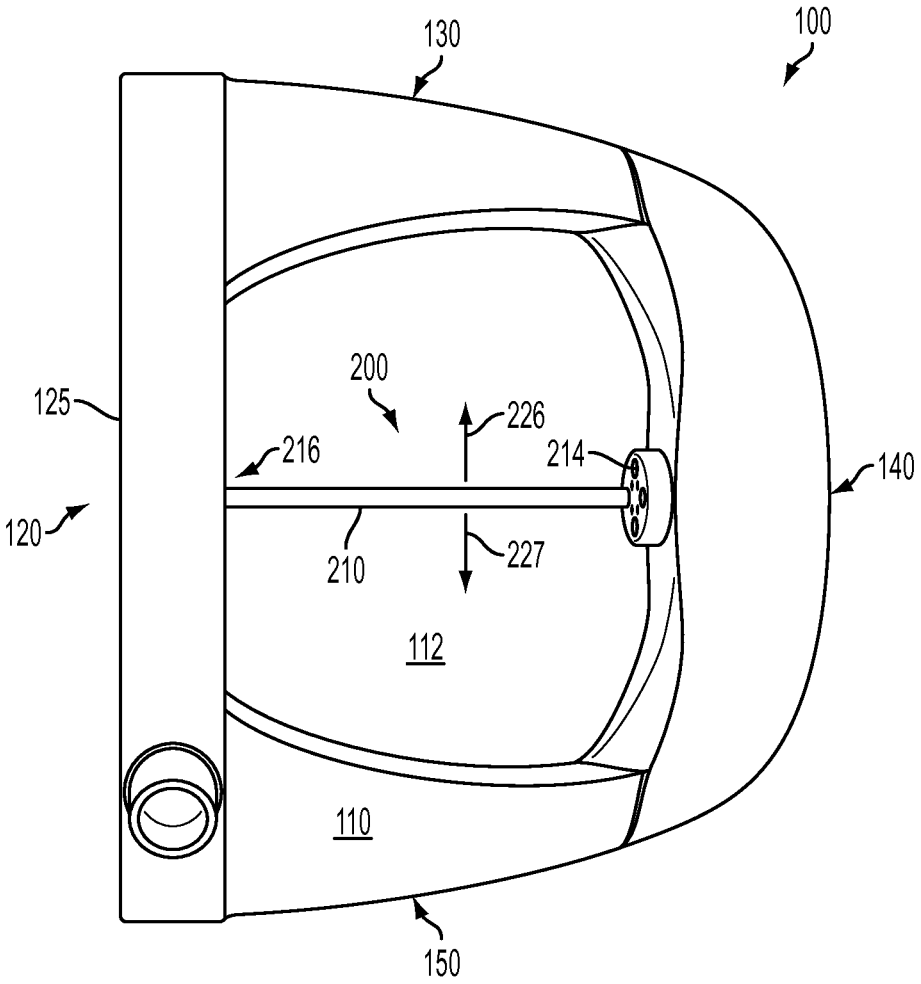

In FIGS. 3A-3E, the recess extends fully through the golf club head. In this configuration, the adjustable alignment aid 200 may be described as being an off-axis pin 210 and eccentric rotating locator 212. The rotating locator 212 may be coupled to the front surface 145 of the rear 140 via a pin or screw so long as that locator may rotate along its axis but also be held in place once the desired position is obtained. Rotating locator 212 contains at least one hole for receiving off-axis pin 210. Rotating locator 212 may be of any suitable shape such as triangular, square, octagonal, or round. Any suitable number of holes, e.g. 1, 2, 3, or 4, along the periphery edge of the rotating receiver may be contained within rotating locator 212. Further, in this particular configuration, the rotating locator is round and has four holes spaced evenly along the periphery. The rotating locator 212 receives the off-axis pin 210 in any one hole in the locator. FIG. 3A depicts off-axis pin 210 in a hole positioned on the heel side of the club head 100. FIG. 3B depicts off-axis pin 210 in a hole positioned in the bottom side of the club head 100. The off-axis pin 210 is moved between positions by rotating the rotating locator. As can be seen and demonstrated in the figures, off-axis means that the pin is never perpendicular to the front 120 of the club head. That is, the pin is always at an angle to the front 120 of the club head.

The adjustable alignment aid 200 is pivotally coupled to a single hole 216 (FIG. 3C1) in the back surface 126 of front 120 of the putter head 100. The single hole is configured to allow the off-axis pin 210 to pivot in the hole. Hence the hole is generally wider at the opening, e.g. a truncated cone shape, to allow such pivoting.

Figures 1, 3C:
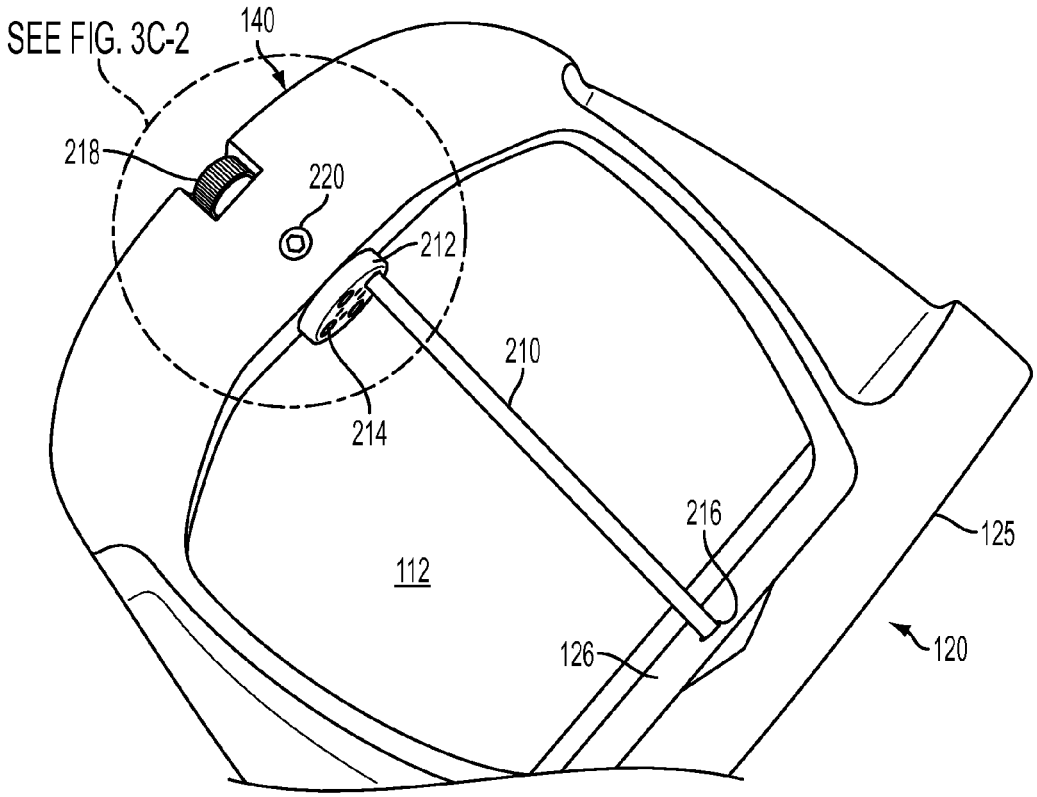
Figures 2, 3C:
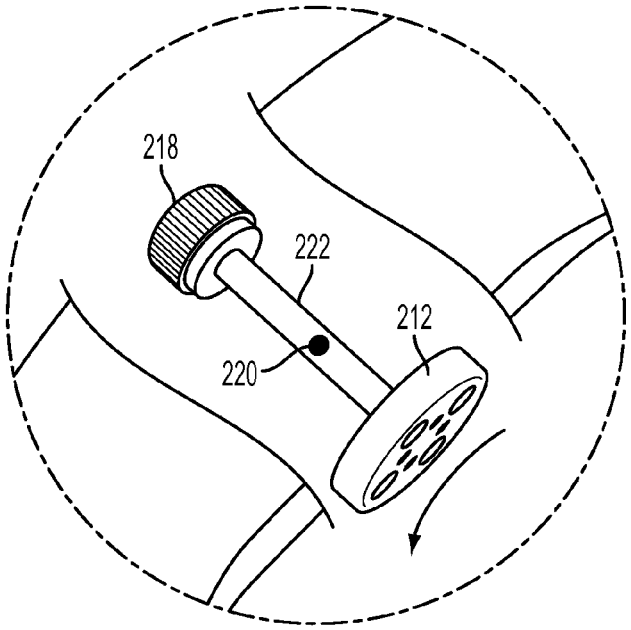
Figure 3D:
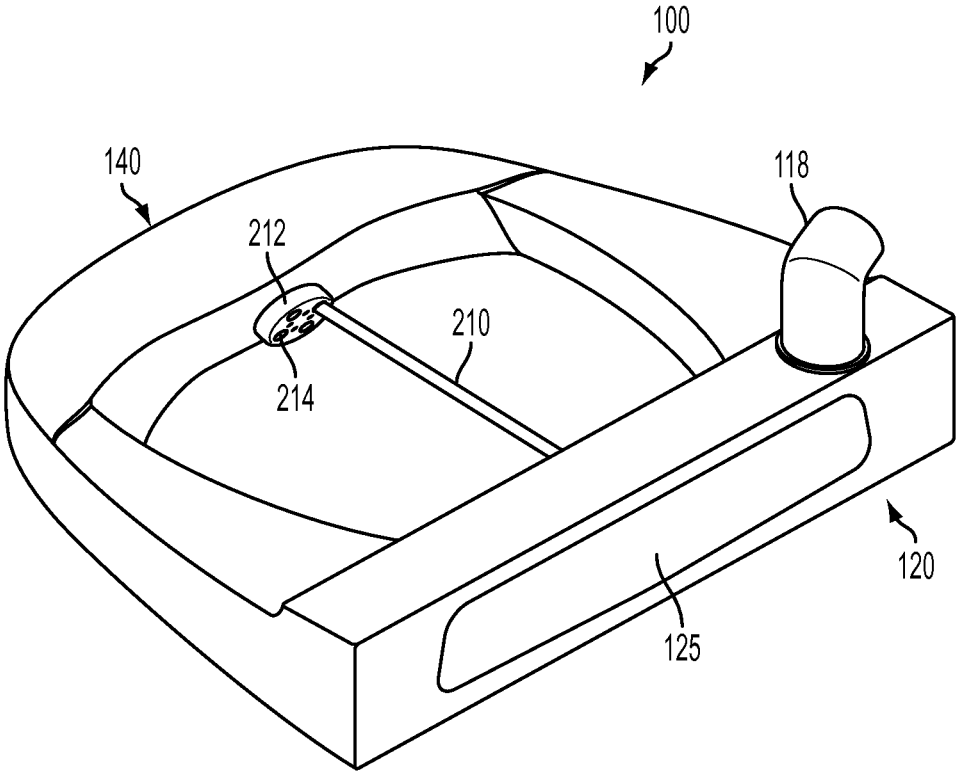
Figure 3E:
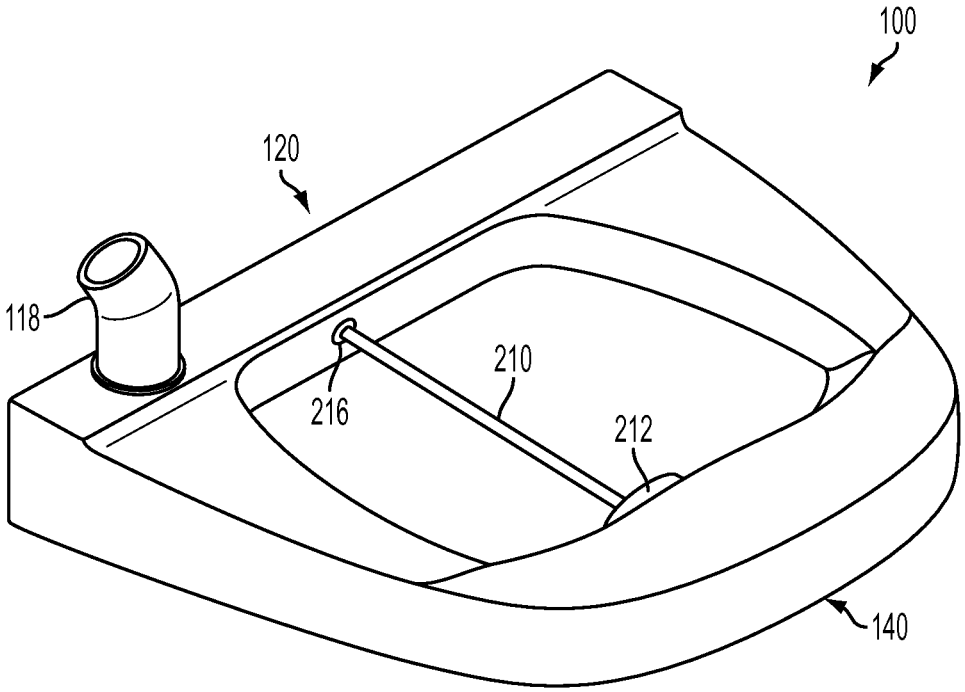

This configuration allows for the angle of an alignment aid to be adjusted in order for it to be custom fitted to a player's desired angle. The alignment aid angle is adjustable by moving the off-axis pin via the rotating locator. The adjustable alignment aid may adjusted by applying a force to either the off-axis pin or the rotating locator. As shown in FIG. 3C-2, the adjustable alignment aid may also be adjusted by a knob 218 which is connected to the rotating locator 212 via a rod 222, for example. Turning the knob, turns the rod, which turns the rotating locator. See inset in FIG. 3C. Typically a user utilizes his or her fingers to adjust the orientation of the adjustable alignment aid 200. Alternatively, a tool (e.g. pliers) may be used to provide the adjustment. The alignment aid may be locked into position using a set screw 220 or other mechanical means.

Figure 3F:
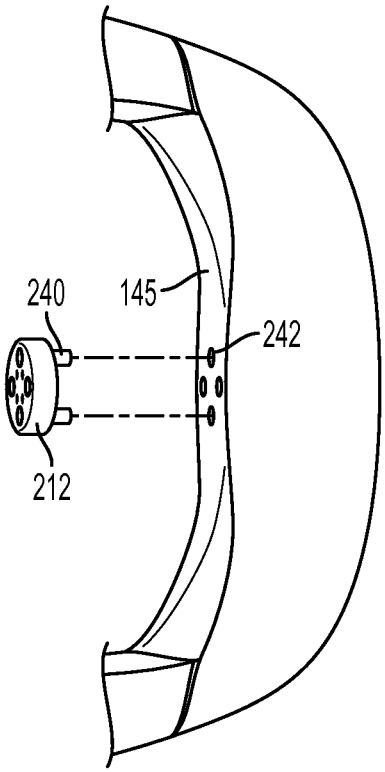
FIG. 3F is a detailed perspective view of a portion of FIG. 3A.

A force resistive to rotation may be used to prevent undesired rotation of the rotating element such as friction. For example, friction may be used to prevent rotation of the rotational element until direct application of a force to the pin or rotating element. Alternatively the rotating element may include a mechanism to allow incremental movement of the rotating element. See FIG. 3F. For example, the rear side of rotating locator 212 may have at least one protrusion 240 along its periphery with apertures 242 in the front surface 145 of rear 140. When secured in place, the protrusion is aligned with an aperture. When the rotating locator is adjusted, the locator is rotated such that the protrusion(s) moves from one aperture to another aperture. Of course the rotating locator may contain the apertures and the front surface 145 of rear 140 may contain the at least one protrusion.

The adjustable alignment aid 200 in the configuration depicted in FIG. 3B illustrates adjustable alignment aid 200 in an off-set bottom position. In an off-set bottom position the off-axis pin 210 is shown as being centrally off-set from the front surface 120 and hitting surface 125 of the putter head 100. From this off-set bottom position, the adjustable alignment may be adjusted in either of two opposing directions 226, 227. Directional arrows 226, 227 illustrative depict the two opposing direction of direction that off-axis pin 210 may be rotated about rotating locator 212 as well as a range of rotation that the corner 215 of the pivotable alignment aid can be rotated.

It is noted that although the off-set pin is never perpendicular to the plane of the front in a three-dimensional view, when viewed from above as a two-dimensional view, the offset-pin will appear perpendicular to the front when the rotating locater has been positioned such that the off-set pin is either at the bottom or at the top of the club head. This then allows for the golfer to align his shots as discussed in regard to FIG. 4.

Figure 4:
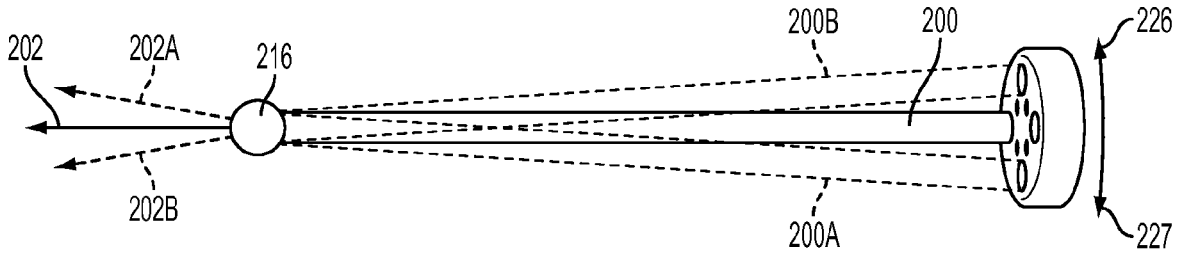
FIG. 4 is an enlarged illustrative schematic top view of an adjustable alignment aid for a golf club head.

FIG. 4 is an enlarged illustrative schematic top view of an adjustable alignment aid 200 for a golf club head further demonstrating the movement and/or rotational characteristics of one configuration of adjustable alignment aid. The broken line 200A shows the adjustable alignment aid 200 after being rotated a range of rotation/direction 227. The broken line 200B shows the adjustable alignment 200 after being rotated a range of rotation/direction 226.

In position 200A, a desired travel path 202A of the golf ball 201 may be visually indicated using the adjustable alignment aid 200. Accordingly, the golfer 10 (of FIG. 2) will have rotated the adjustable alignment aid 200 into an orientation or position in his eye line with the rotated adjustable alignment aid 200A and thereby aligning the desired travel path 202A. In position 200B, a desired travel path 202B of the golf ball may be visually indicated using the adjustable alignment aid 200. Accordingly, the golfer 10 will have rotated the adjustable alignment aid 200 into an orientation or position in his eye line with the rotated adjustable alignment aid 200B and thereby aligning the desired travel path 202B.

First, a golfer would be placed in his or her putting stance, e.g., with the player in a ball address position and a ball set up to be hit along a desired line of travel (e.g., toward a hole). Thus, the golfer would be placed in a position like shown in FIG. 2. With the player in that position, the player's eyes are not necessarily located directly over the ball and/or the putter head (although some players strive to position their eyes directly over the ball, most players have their head (and eyes) located inside and/or rearward from the ball's location). Therefore, with the player at the ball address position, a third party (e.g., club fitter, etc.) would change the position of the adjustable alignment aid until it appeared to the player (while still at the ball address position) to be located square to the target line 202. While this may, in fact, position the alignment aid 200 along the lines 200A/200B shown in FIG. 4, from the player's perspective, it will look like the alignment aid 200 is aligned with and square to target line 202. Once the alignment aid 200 is properly positioned from the player's perspective at a ball address position, it is locked in place (and typically maintained in that position for the long term—one wouldn't typically adjust this positioning unless there was a change to the golfer's vision and/or set-up orientation). The player would hit the ball square to the face and along target line 202, and the adjustability of the alignment aid 200 merely helps make it look like the alignment aid 200 is square to the front ball striking face of the putter head as the player stands over the putt.

As discussed above, when the golfer views the adjustable alignment aid, he sees a two dimensional view of the pin. That is, although, for example in the position that the pin is located at the bottom of the rotating element in the aspect depicted in FIG. 3B, and is actually off-set from a horizontal position, the golfer merely sees that the angle of the pin is perpendicular to the face.

While FIG. 4 demonstrates the position and orientation of the adjustable alignment aid 200 in a position 200A and 200B, it should be understood and evident that numerous positions and orientations along various ranges of rotations may be utilized and are consistent with the principles described herein. For each of a number of golf shots, and putts in particular, a golfer may rotate the adjustable alignment aid a certain distance and direction as desired in light of the specific characteristics of the shot or putt. In certain configurations, the ranges of motion from the start or square position may be equivalent in opposing directions. However, the ranges of motions may also be formed to be different in the opposing directions 226, 227 or the adjustable alignment aid 200 in certain configurations may be formed to only be able to rotate in one direction from the start position or addressing state. On any given putt the golfer may move the adjustable alignment aid 200 a small amount in one direction, a large amount in the other opposing direction and practically any other combination of rotation distances, and directions.

The adjustable alignment aid, in any aspect, may be adjusted over a range of angles. For example, in FIG. 4, the angles depicted by positions 200A and 200B may be up to 15 degrees from centered position 200 measured from the hole 216 as the vertex. Thus the centered position 200 is considered a 0 angle and position 200A is at a 15 degree angle.

FIGS. 5A-C, 6A-6C, 7A-7E, and 8A-8B depict further configurations of a putter head 100 including an adjustable alignment aid 500/600. Each configuration demonstrates varied features, aspects and particulars regarding the putter head 100 and its associated pivotable alignment aid 500/600. While each of these putter heads for 100 may be shaped and shown to have a certain shape and size, it is known that putter heads may have many varied shapes, sizes and geometries. It is known that golf club heads for putters may be circular, square, elongated, intricate geometric shapes and an extremely large number of shapes and geometries. As such, the described putter heads 100 shown and described herein are illustrative as various other particular shape, sizes and other characteristics etc., are specifically contemplated consistent with that described herein.

Figure 5A:
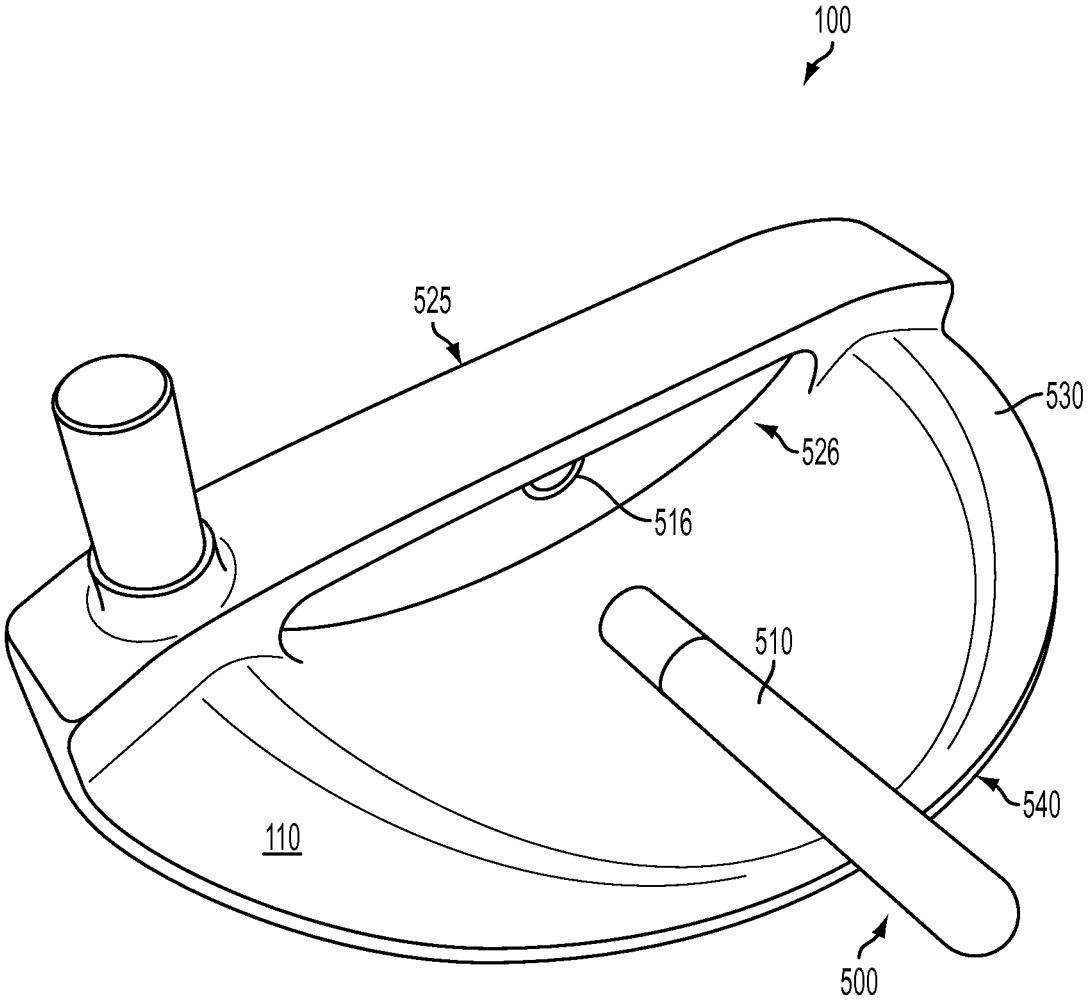
FIGS. 5A-5C are illustrative schematic front perspective and top views of another arrangement of a putter head including an adjustable alignment aid.
Figure 5B:
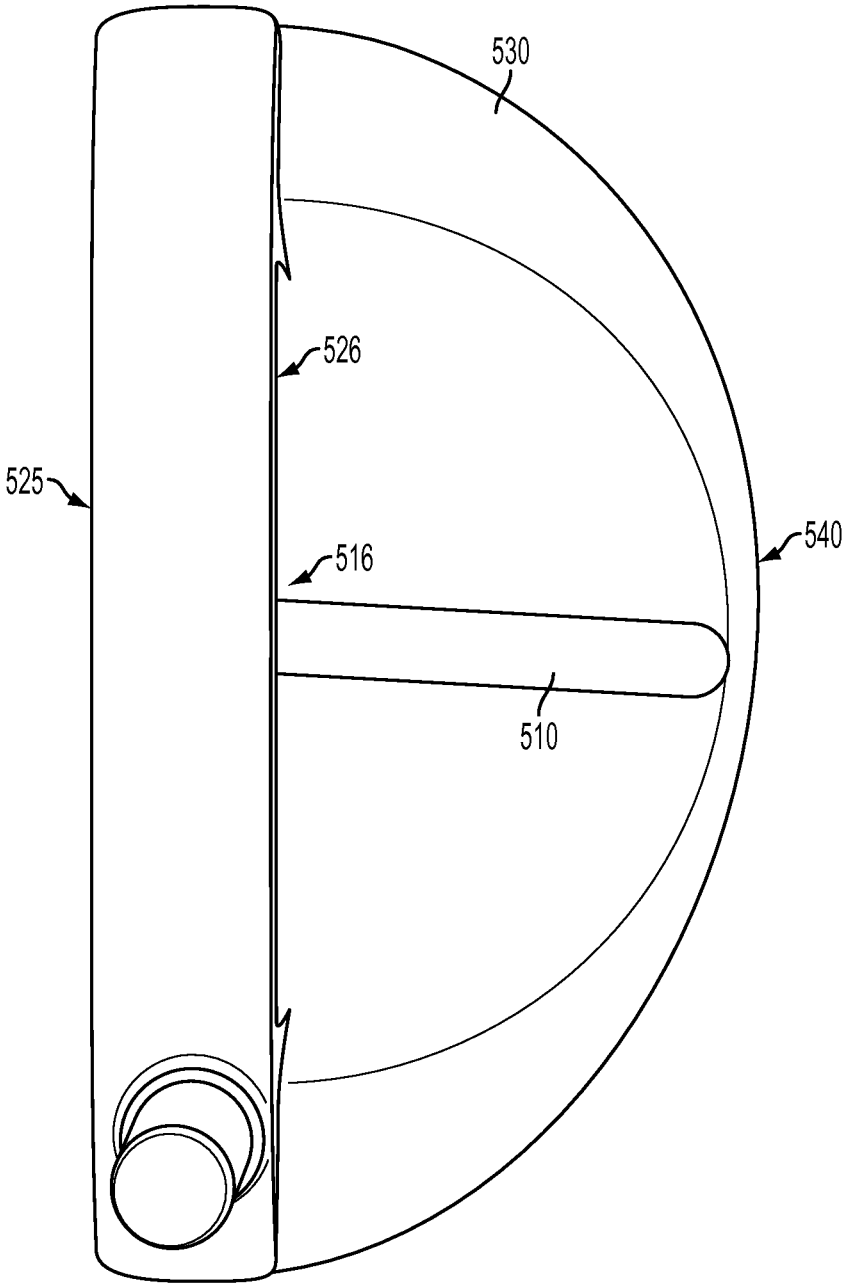
Figure 5C:
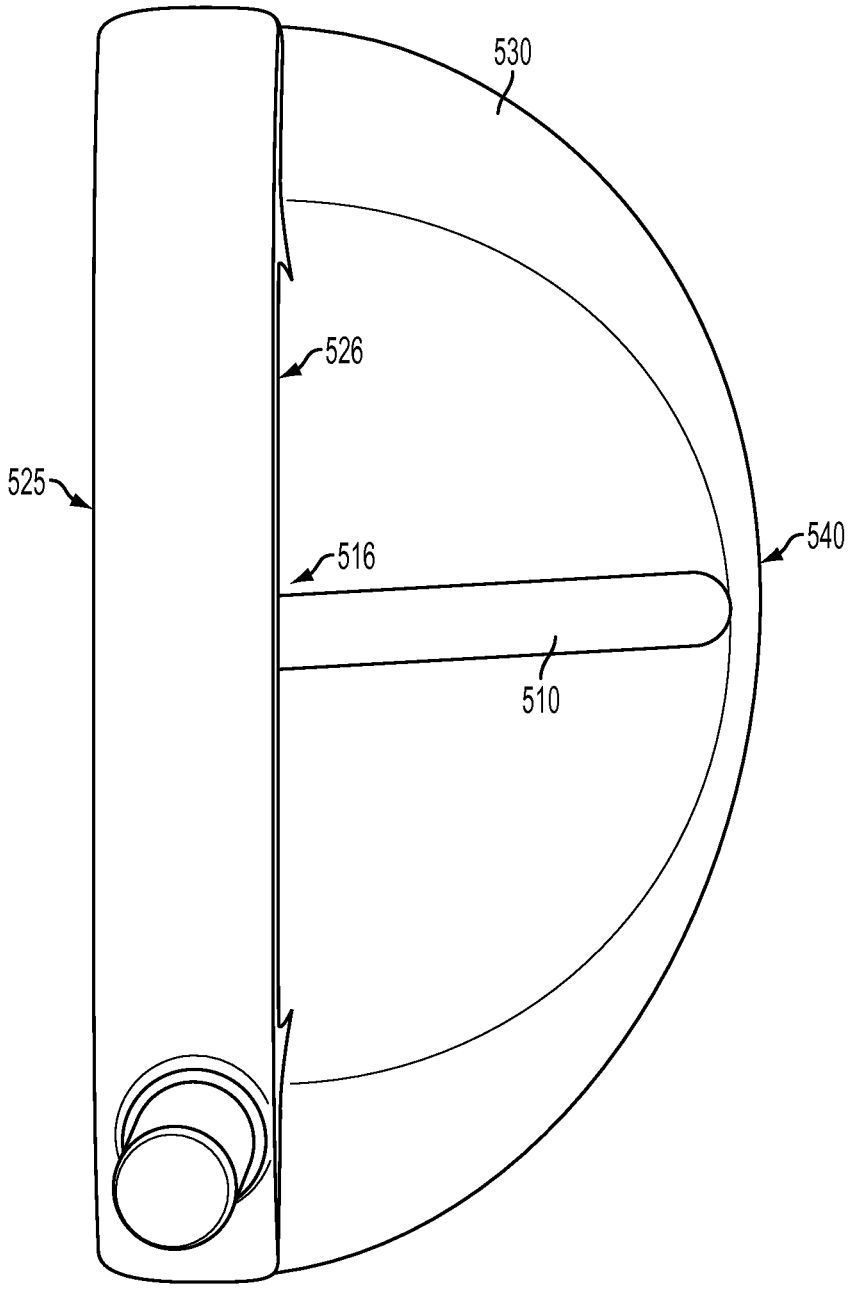

FIGS. 5A-5C illustratively depict a further configuration of a putter head 100 including an adjustable alignment aid 500. FIG. 5A is a front perspective and FIGS. 5B and 5C show top views of a putter head 100 that includes an adjustable alignment aid 500 housed in recess 512 in top surface 110 of the golf club head 100. In FIGS. 5A-5C, the recess extends from the top and partially through the golf club head. As shown in FIG. 5A, the recess has a concave configuration. Any suitable recess shape may be utilized so long as the adjustable alignment aid can move unimpeded. In this configuration, the adjustable alignment aid 500 may be described as being a pin 510. The adjustable alignment aid 500 is pivotally coupled to a single hole 516 in the back surface 126 of front 120 of the putter head 100. The single hole is configured to allow the pin 210 to pivot along a horizontal plane or three-dimensionally in the hole.

The pin 500 may be coupled to the single hole 516 by any suitable means to allow movement pin. For example, the pin may have a ball formed at one end, and hole 516 may be in the form of a joint that receives the ball. The ball may fit snugly in the joint so as to allow movement of the pin but otherwise hold the ball in place. Other means may be used to adjust the pin or lock the pin in place.

This configuration allows for the angle of an alignment aid to be adjusted in order for it to be custom fitted to a player's desired angle. The adjustable alignment aid may adjusted by applying a force to the pin. Such force will typically be applied by a user via his or her hand to adjust the orientation of the adjustable alignment aid 500. Alternatively, a tool may be used to provide the adjustment.

Figure 6A:
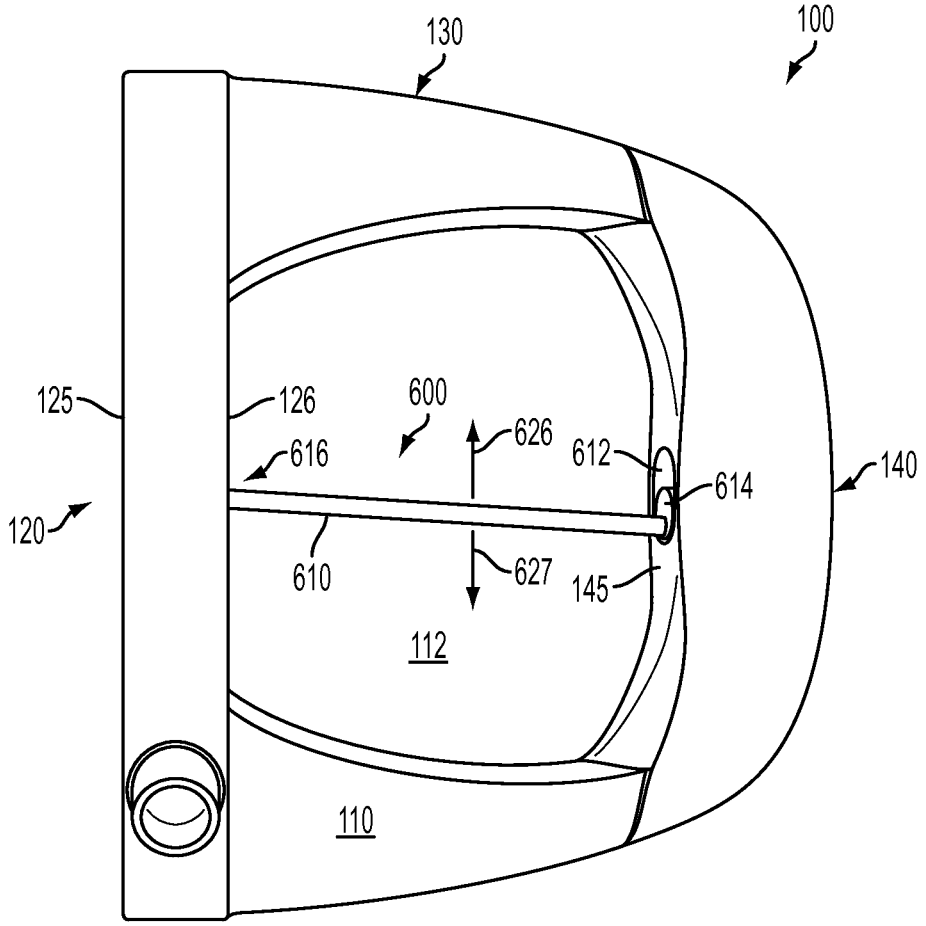
FIGS. 6A-6C are illustrative schematic top (2) and rear perspective views of another arrangement of a putter head including an adjustable alignment aid.
Figure 6B:
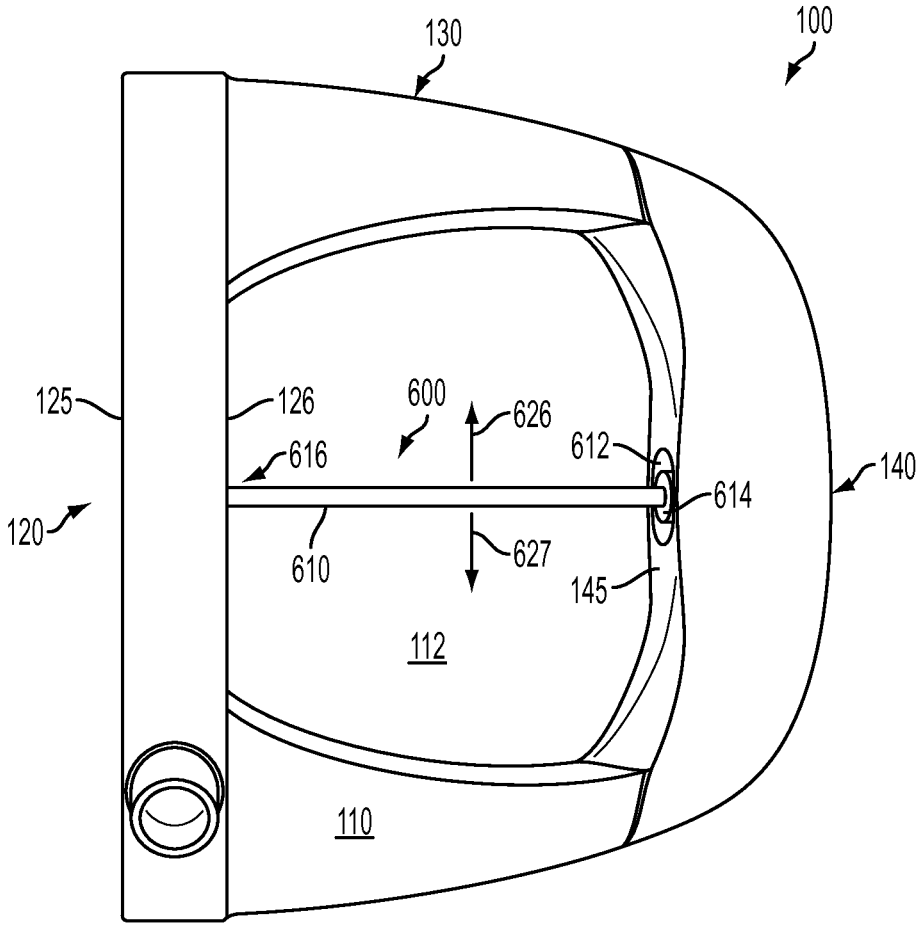
Figure 6C:
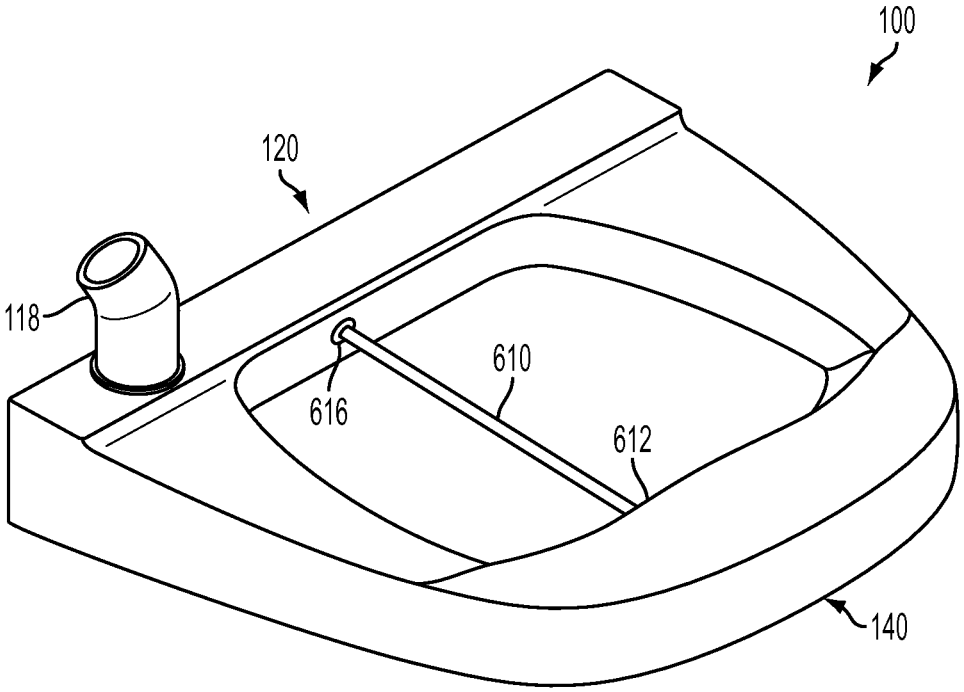

The adjustable alignment aid 500 in the configuration depicted in FIG. 5B illustrates adjustable alignment aid 500 in an off-set position. The adjustable alignment aid 500 in the configuration depicted in FIG. 5C illustrates adjustable alignment aid 200 in a position perpendicular to the front surface. This aspect may be the simplest to achieve FIGS. 6A-6C illustratively depict a further configuration of a putter head 100 including an adjustable alignment aid 600. Here, instead of a rotating locator, a slider riding within a slot is utilized. FIGS. 6A-6C are top (2) and front perspective views of a putter head 100 that includes an adjustable alignment aid 600 housed in recess 112 in top surface 110 of the golf club head 100. In FIGS. 6A-6C, the recess extends fully through the golf club head. In this configuration, the adjustable alignment aid 600 may be described as being a pin 610 and slider 614 in a slot 612. The slot may be located in the front surface 145 of the back 140 either as a slot in the surface or as a slot coupled to the surface. A slider 614 is placed in the slot such that it may slide the distance of the slot. One end of pin 610 is located in the slider and moves with the slider in a generally horizontal direction from the toe end to the heel end of the slot. FIG. 6A depicts pin 610 in a hole positioned on the heel side of the club head 100. FIG. 6B depicts pin 610 in a center position of the club head 100. The pin 610 is moved between positions by sliding the slider along the slot.

The adjustable alignment aid 200 is pivotally coupled to a single hole 616 (FIG. 6C) in the back surface 126 of front 120 of the putter head 100. The single hole is configured to allow the pin 610 to pivot in the hole. Hence the hole is generally wider at the opening, e.g. a truncated cone shape, to allow such pivoting.

This configuration allows for the angle of an alignment aid to be adjusted in order for it to be custom fitted to a player's desired angle. The alignment aid angle is adjustable by moving the pin via the slider. The adjustable alignment aid may adjusted by applying a force to either the pin or the slider. Such force will typically be applied by a user via his or her hand to adjust the orientation of the adjustable alignment aid 600. Alternatively, a tool may be used to provide the adjustment.

The adjustable alignment aid 600 in the configuration depicted in FIG. 6B illustrates adjustable alignment aid 600 in a center position. In an off-set bottom position the off-axis pin 610 is shown as being centrally off-set from the front surface 120 and hitting surface 125 of the putter head 100. From this off-set bottom position, the adjustable alignment may be adjusted in either of two opposing directions 626, 627. Directional arrows 626, 627 illustrative depict the two opposing direction of direction that pin 610 may be moved via slider 614 in slot 612.

A force resistive to rotation may be used to prevent undesired movement of the slider within the slot such as friction. For example, the friction prevents the slider from sliding in the slot until direct application of a force to the pin or slider. The alignment aid may be locked into position using a set screw or other mechanical means. Alternatively the slider may include a mechanism to allow incremental movement of the slider in the slot. For instance, the rod and slider may have a protrusion/aperture arrangement similar to what is described for FIG. 3F. For example, pin 610 may have a protrusion extending from its end that may be moved from aperture to aperture formed in the slider.

Figure 7A:
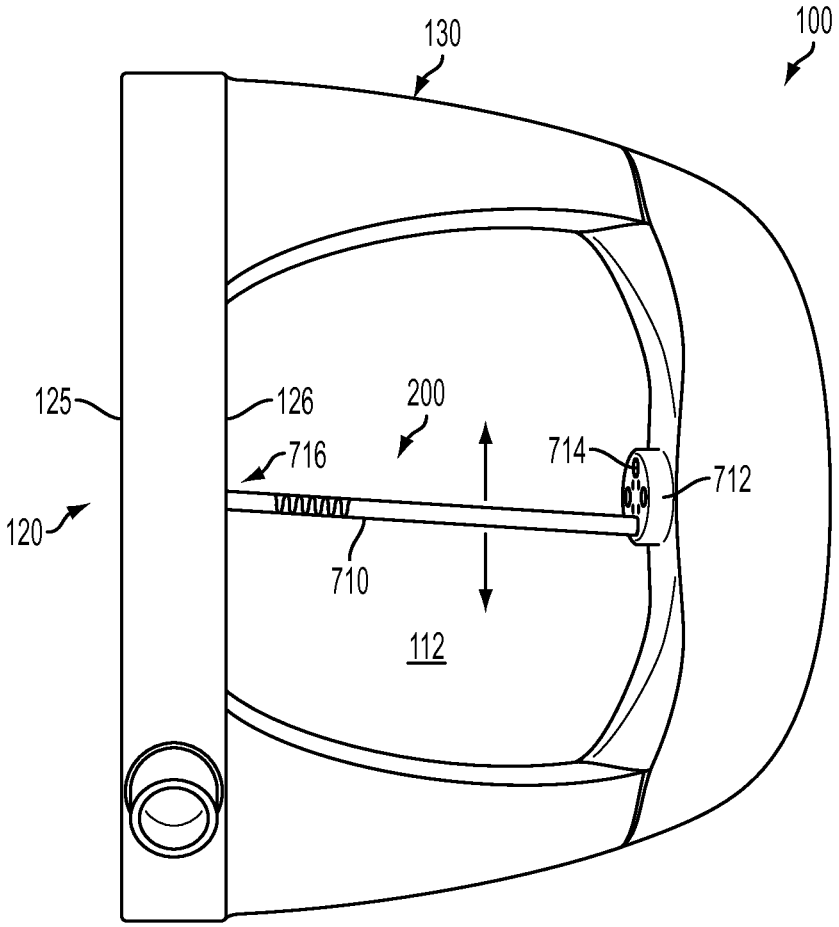
FIGS. 7A-7B are illustrative schematic top (2) views of another arrangement of a putter head including an adjustable alignment aid.
Figure 7B:
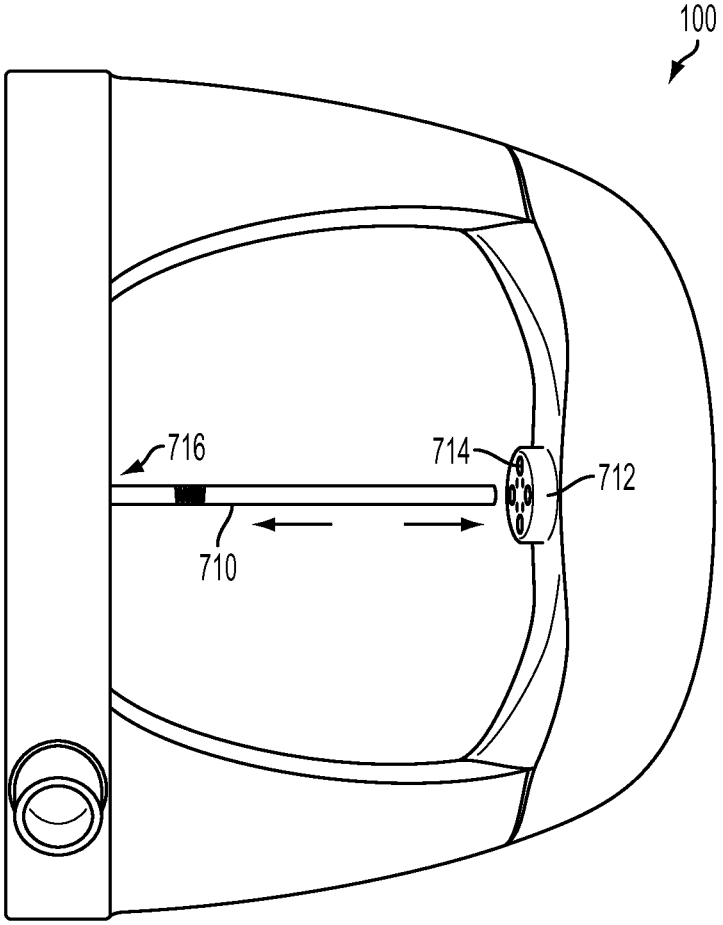

FIGS. 7A-7B are top (2) views of putter head 100 that includes an adjustable alignment aid 700 housed in recess 112 in top surface 110 of the putter head 100. Similar to the aspect described in FIGS. 3A-3E, the golf club head may be formed of one or several pieces.

In FIGS. 7A-7B, the recess extends fully through the putter head. In this configuration, the adjustable alignment aid 700 may be described as being a spring-loaded or compressible pin 710 and permanently positioned locator 712. The locator 712 may be coupled to the front surface 145 of the rear 140 via adhesive or screw. Locator 712 contains at least one hole for receiving pin 710. Locator 712 may be of any suitable shape such as rectangular, square, octagonal, or round. Any suitable number of holes, e.g. 1, 2, 3, 4, 5, 6, 7, or 8 may be contained within locator 712. The locator 712 receives the pin 710 in any one hole in the locator. FIG. 7A depicts pin 710 in a hole positioned on the heel side of the club head 100. FIG. 7B depicts pin 710 in a hole positioned in the middle of the club head 100. As can be seen and demonstrated in the figures, the pin need not be perpendicular to the front 120 of the club head. That is, the pin may be at an angle to the front 120 of the club head.

The single hole is configured to allow the pin 710 to pivot in the hole. Hence the hole is generally wider at the opening, e.g. a truncated cone shape, to allow such pivoting.

This configuration allows for the angle of an alignment aid to be adjusted in order for it to be custom fitted to a player's desired angle. The alignment aid angle is adjustable by moving the spring-loaded or compressible pin 710. For example, the pin may be compressible such as containing a spring-loaded mechanism to allow compression of the pin. The adjustable alignment aid may adjusted by applying a force to the pin to shorten its length via the spring and then moving the end of the pin into another hole on the locator. The spring should allow compression of the pin 710 but also be stiff enough to firmly hold the pin in place after movement to a hole.

The adjustable alignment aid 700 in the configuration depicted in FIG. 7B illustrates adjustable alignment aid 700 in a middle position.

Figure 8A:
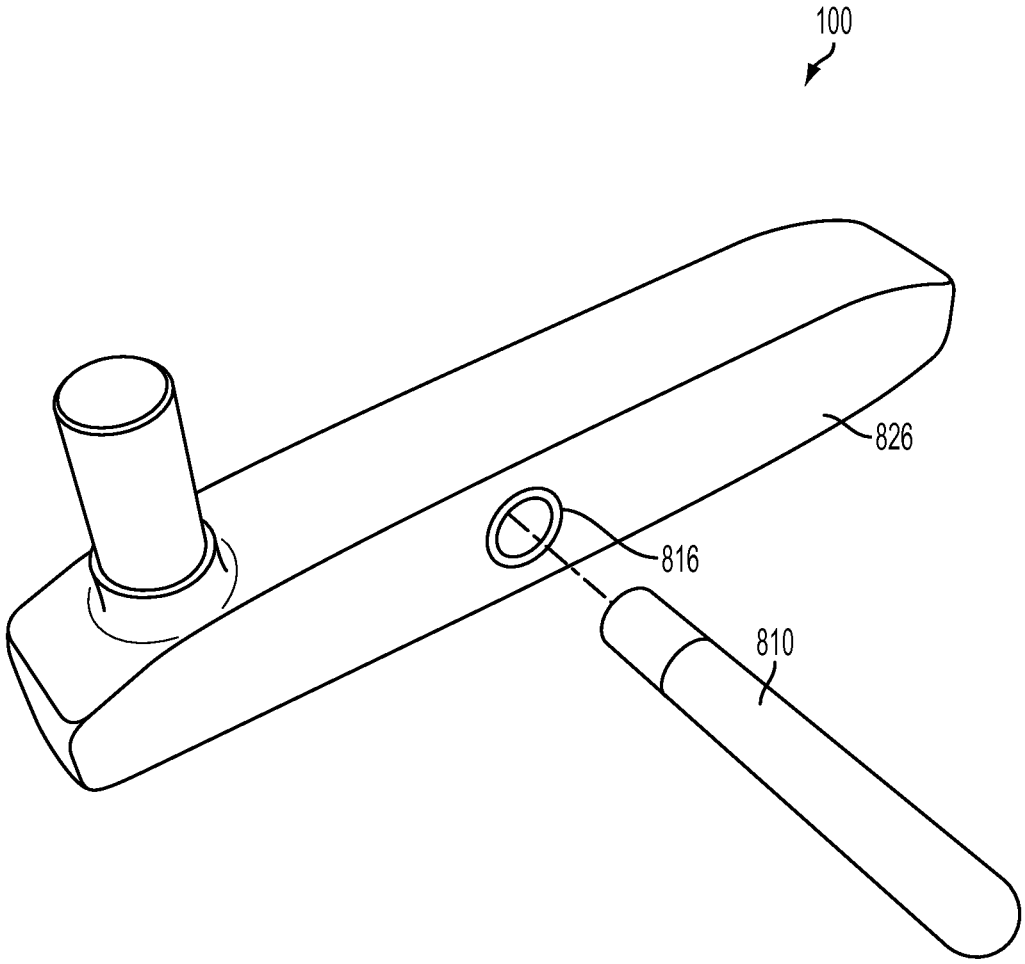
FIGS. 8A-8B are illustrative schematic front perspective and top view of another arrangement of a putter head including an adjustable alignment aid.
Figure 8B:
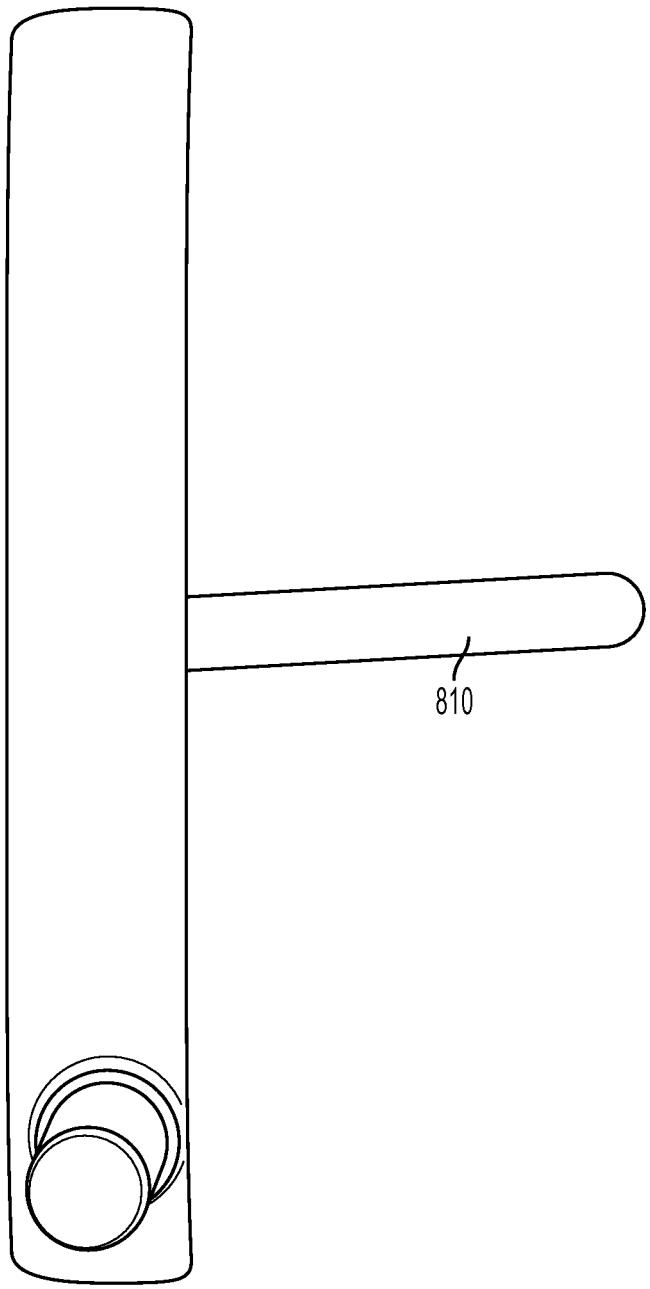

FIGS. 8A-8B illustratively depict a further configuration of a putter head 100 including an adjustable alignment aid 800. FIG. 8A is a front perspective and FIG. 8B is a top view of a putter head 100 that includes an adjustable alignment aid 800 extending from the rear of the putter head. In this configuration, the adjustable alignment aid 800 may be described as being a pin 810. The adjustable alignment aid 800 is pivotally coupled to a single hole 816 in the back surface 126 of front 120 of the putter head 100. The single hole is configured to allow the pin 810 to pivot along a horizontal plane or three-dimensionally in the hole. The pin may be coupled to the single hole as described above for the aspect of FIGS. 5A-5C.

In any aspect of the invention, the adjustable alignment aid is described as a pin. Although the pin may be cylindrical in shape as shown in the figures, it is contemplated that that other shapes may be used such as a triangular or rectangular or other multi-sided prism. The holes that receive the pin in the rear surface of the front or in the rotating element or slide should be configured to accommodate the cross-section of the pin. Likewise, the pin may be of any suitable cross-section that allows the user to visibly determine the desired angle.

In any aspect of the present invention, the pin may be of any color or combination of colors and designs to allow the user to clearly see the pin. For example, the pin may contain stripes, preferably extending end to end along the axis of the rod. The stripe may be shaded, distinctly colored, textured, or reflective surface that may provide a bold and eye-catching visual impression. With this bold or eye-catching impression the golfer may more easily view the pin from an elevated position such as in a typical putting stance or other distances in which a golfer may view the putter head 100 during a round of golf or during practice shots at a golf range or putting green. Bright colors or colors that contrast with the ground and/or the top surface 110 are contemplated. Also, reflective stripes and other techniques for making features visibly prominent are also contemplated.

Figure 9:
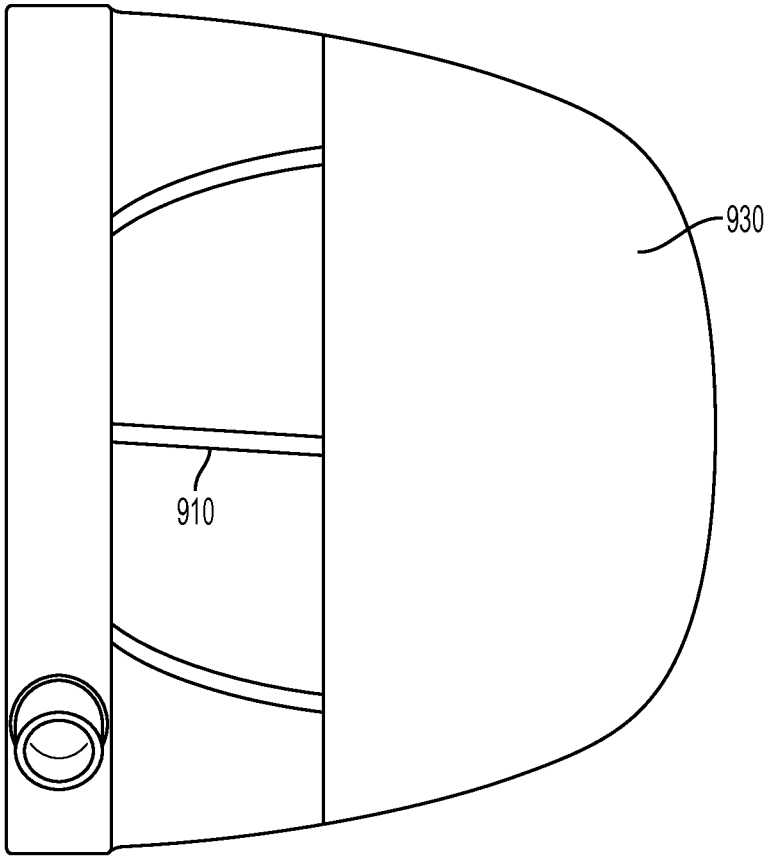
FIG. 9 is an illustrative top plan view of a putter head having a cover.

In any aspect of the present invention, all or portions of the adjustable alignment aid may be hidden from view. Such may be achieved by a shield or a cover. For example, as shown in FIG. 9, a shield 930 may be placed over the rear part of the putter head to cover (hide) the locator e.g. rotatable locator 214 or slide 612, leaving only the pin 910 exposed. Such a shield may be a permanent or removable structure. In this manner, the adjustable features of the club head may be accessible only from a bottom side of the putter head.

Alternatively, if desired, a removable cover may be placed over the entire adjustable alignment aid and may be coupled in any suitable manner such as snapped into place or held on by screws.

Alternatively, the locator e.g. rotatable locator 214 or slide 612 may be placed in a recess in the rear of the golf club head.

Aspects of the invention may include a kit for retrofitting an existing club head.

Illustrative aspects of the present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The invention claimed is:

1. A golf club head comprising:

a body having a front, a rear, a toe, a heel, a top, and a bottom;

an adjustable alignment aid having an off-axis rotation and coupled to a rear surface of the front, the adjustable alignment aid extending rearwardly;

an interior recess extending at least partially downward from the top and positioned adjacent the front, between the toe and the heel, the rear surface of the front being adjacent the recess, wherein the recess allows unimpeded movement of the adjustable alignment aid; and wherein the recess extends through the body from the top to the bottom.

2. The golf club head of claim 1 wherein the front comprises a front surface, wherein the front surface includes a hitting surface.

3. The golf club of claim 1 wherein the recess forms a concave surface in the body.

4. The golf club head of claim 1 wherein the adjustable alignment aid is non-removably housed in the body.

5. The golf club head of claim 1 wherein the adjustable alignment aid comprises a pin pivotally coupled to the rear surface of the front and extending rearwardly.

6. The golf club of claim 5 wherein the pin pivots in a circular motion.

7. The golf club of claim 5 wherein the pin is adjustable relative to a front surface of the rear and about an axis of rotation transverse to the rear surface of the front.

8. The golf club head of claim 7 wherein the pin is coupled to a rotating element coupled to the front surface of the rear of the golf club body.

9. The golf club head of claim 8 wherein the adjustable alignment aid is configured to permit a rotating end of the pin to rotate about the rotating element.

10. The golf club head of claim 9, wherein the rotating element is configured to provide a force resistive to rotation in both of opposing directions of rotation.

11. The golf club head of claim 10, wherein the force resistive to rotation is friction between the adjustable alignment aid and the front surface of the rear, wherein the friction prevents rotation of the rotational element until direct application of a force to the pin or to the rotating element.

12. The golf club head of claim 8, wherein a rear side of the rotating element includes at least one protrusion and the front surface of the rear includes apertures to allow incremental movement of the rotating element.

13. The golf club head of claim 1 further comprising a cover that at least partially covers the adjustment alignment aid.

14. The golf club head of claim 1, further comprising a shaft coupled to the body.

15. The golf club head of claim 14, wherein the golf club head is configured for a putter.

16. The putter head of claim 1, wherein the adjustable alignment aid is configured to be visually distinct relative to the top of the body.

17. A golf club head comprising:

a body having a front, a rear, a toe, a heel, a top, and a bottom;

an adjustable alignment aid comprising a pin pivotally coupled to a single hole in a rear surface of the front, the adjustable alignment aid extending rearwardly;

wherein the golf club head is configured for a putter head; and wherein the adjustable alignment aid is visible from a top side of the body;

wherein the pin is coupled to a slider contained within a slot coupled to or formed in a front surface of the rear of the golf club body.

18. The golf club head of claim 17 wherein the adjustable alignment aid is non-removably housed in the body.

19. The golf club of claim 17 wherein the pin pivots in a horizontal plane.

20. The golf club head of claim 17 wherein the adjustable alignment aid is configured to permit an end of the pin connected to the slider to move horizontally when the slider is moved within the slot.

21. The golf club head of claim 17, wherein the slider and the slot are configured to provide a force resistive to movement of the slider in the slot.

22. The golf club of claim 17 wherein the slider has a connector that may be loosened or tightened, respectively, to allow or prevent movement of the slider in the slot.

23. A golf club head comprising:

a body having a front, a rear, a toe, a heel, a top, and a bottom;

an adjustable alignment aid having an off-axis rotation and coupled to a rear surface of the front, the adjustable alignment aid extending rearwardly;

wherein the adjustable alignment aid comprises a pin pivotally coupled to the rear surface of the front and extending rearwardly;

wherein the pin is adjustable relative to a front surface of the rear and about an axis of rotation transverse to the front surface of the rear; and wherein the pin is coupled to a rotating element coupled to the rear front surface of the golf club body.

* * * * *